US009932922B2

(12) United States Patent
McEwan

(10) Patent No.: US 9,932,922 B2
(45) Date of Patent: Apr. 3, 2018

(54) POST-CATALYST CYLINDER IMBALANCE MONITOR

(71) Applicant: Ford Global Technologies, LLC, Dearborn, MI (US)

(72) Inventor: Douglas James McEwan, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 329 days.

(21) Appl. No.: 14/528,872

(22) Filed: Oct. 30, 2014

(65) Prior Publication Data

US 2016/0123257 A1 May 5, 2016

(51) Int. Cl.
*F02D 41/00* (2006.01)
*F02D 41/14* (2006.01)

(52) U.S. Cl.
CPC ..... *F02D 41/0085* (2013.01); *F02D 41/1441* (2013.01); *F02D 41/1454* (2013.01)

(58) Field of Classification Search
CPC ..... F02D 41/0085; F02D 41/1441; F02D 41/1454; F02D 2200/1012; F02D 37/02; F02D 41/1456; F02D 41/1445; F02D 41/1446; F02D 2041/1433; F02D 2041/1434; F02D 2041/1436; F02D 2041/1437
USPC ..... 701/102–105, 109, 114, 29.1, 32.8, 32.9, 701/32.1; 123/406.12, 406.26, 406.27, 123/436, 673, 674, 691–692, 703, 704; 73/23.32, 114.71–114.73; 702/183; 60/276, 285
See application file for complete search history.

(56) References Cited

U.S. PATENT DOCUMENTS 4,766,870 A * 8/1988 Nakajima ..... F02D 41/008 123/674
4,869,222 A * 9/1989 Klassen ..... F02D 41/0085 123/486
5,067,463 A * 11/1991 Remboski ..... F02D 35/022 123/406.28
5,243,952 A 9/1993 Ikuta et al.
5,392,599 A 2/1995 Hamburg et al.
5,462,037 A 10/1995 Hasegawa et al.
5,524,598 A 6/1996 Hasegawa et al.
5,548,514 A 8/1996 Hasegawa et al.
5,806,506 A * 9/1998 Kitamura ..... F02D 41/008 123/673
6,314,952 B1 11/2001 Turin et al.
(Continued)

OTHER PUBLICATIONS

Wald, A. Sequential Tests of Statistical Hypotheses. Ann. Math. Statist. 16 (1945), No. 2, 11.pdf.*
(Continued)

*Primary Examiner* — David Hamaoui
*Assistant Examiner* — Carl Staubach
(74) *Attorney, Agent, or Firm* — Julia Voutyras; McCoy Russell LLP

(57) ABSTRACT

Methods and systems are provided for detecting cylinder air-fuel imbalance. In one example, a method may include adjusting engine operation based on an indication of cylinder air-fuel imbalance. The imbalance may be detected based on output from a second exhaust gas sensor and a plurality of individual cylinder weighting factors, the second sensor located in an exhaust system downstream of a first sensor located in the exhaust system.

15 Claims, 4 Drawing Sheets

(56) References Cited

U.S. PATENT DOCUMENTS

| | | | | |
|---|---|---|---|---|
| 6,382,198 | B1 | 5/2002 | Smith et al. | |
| 7,027,910 | B1 * | 4/2006 | Javaherian | F02D 41/0085 123/406.24 |
| 7,051,725 | B2 | 5/2006 | Ikemoto et al. | |
| 7,497,210 | B2 * | 3/2009 | Okamoto | F02D 13/06 123/673 |
| 7,597,091 | B2 * | 10/2009 | Suzuki | F02D 41/008 123/673 |
| 7,802,563 | B2 | 9/2010 | Behr et al. | |
| 7,926,330 | B2 * | 4/2011 | Huang | F02D 41/0085 73/114.38 |
| 8,191,355 | B2 * | 6/2012 | Lewis | F02D 13/06 123/21 |
| 8,670,917 | B2 * | 3/2014 | Aoki | F02D 41/1454 123/673 |
| 2007/0017210 | A1 * | 1/2007 | Hirata | F02D 41/008 60/274 |
| 2009/0241925 | A1 | 10/2009 | Behr et al. | |
| 2009/0283080 | A1 * | 11/2009 | Matas | F02D 41/1475 123/676 |
| 2011/0282541 | A1 * | 11/2011 | Kidokoro | F02D 41/0085 701/31.4 |
| 2011/0308506 | A1 | 12/2011 | Hayashita et al. | |
| 2013/0184969 | A1 | 7/2013 | Rollinger et al. | |
| 2013/0197782 | A1 | 8/2013 | Genko | |
| 2014/0123943 | A1 | 5/2014 | Varney | |
| 2016/0115879 | A1 * | 4/2016 | Lehmen | F02D 41/1444 701/104 |

OTHER PUBLICATIONS

Wu, Zhijian J. et al., "Estimation of Individual Cylinder Fuel Air Ratios from a Switching or Wide Range Oxygen Sensor for Engine Control and On-Board Diagnosis," SAE Technical Paper Series No. 2011-01-0710, published Apr. 12, 2011, 13 pages.

* cited by examiner

POST-CATALYST CYLINDER IMBALANCE MONITOR

FIELD

The present description relates generally to methods and systems for detecting cylinder air-fuel imbalance.

BACKGROUND/SUMMARY

Modern vehicles use three-way catalysts (TWC) for exhaust after-treatment of gasoline engines. With tightening government regulations on automobile emissions, feedback control is used to adequately regulate the engine air-to-fuel ratio (AFR). Some vehicles have a universal exhaust gas oxygen (UEGO) sensor upstream of the TWC and a heated exhaust gas oxygen (HEGO) sensor downstream of the TWC to control the AFR near stoichiometry. Feedback AFR control in cylinders is achieved by regulating the AFR to a desired AFR around stoichiometry, which in turn is fine-tuned based on the deviation of a HEGO voltage from a pre-determined HEGO-voltage set-point.

However, the physical geometry and arrangement of engine cylinders creates a non-uniform, zoned exhaust flow condition in the exhaust system that makes in cylinder AFR difficult to determine. Various conditions, such as an AFR imbalance between cylinders, may exacerbate this non-uniform, zoned exhaust flow condition so that the UEGO sensor may not equally detect all of the cylinders. An AFR imbalance between cylinders occurs when the AFR in one or more cylinders is different than the AFR in other cylinders due to a cylinder-specific condition, such as an intake manifold leak at a particular cylinder, a clogged fuel injector, an individual cylinder exhaust gas recirculation runner imbalance, or a fuel-flow delivery issue. Due to the zoned exhaust flow, a cylinder with an air-fuel imbalance may only be detected if the cylinder has relatively large imbalance. Thus, smaller imbalances may go undetected, leading to significant feedgas emissions such as carbon monoxide (CO) or the oxides of nitrogen (NOx) passing directly to the tailpipe, as the biased air-fuel mixture is fed directly to the catalyst, overwhelming the oxygen-storage buffer that allows for short deviations from stoichiometry.

The inventors herein have recognized the above issues and have devised various approaches to solve them. In particular, systems and methods for providing the technical result of identifying and mitigating air-fuel imbalance conditions specific to an engine cylinder are provided. In one example, a method comprises adjusting engine operation based on an indication of cylinder air-fuel imbalance, the cylinder air-fuel imbalance detected based on output from a second sensor and a plurality of individual cylinder weighting factors, the second sensor located in an exhaust system at a location downstream of a first sensor located in the exhaust system.

In this way, cylinder air-fuel imbalance may be detected based on the composition of the exhaust gas measured by the second exhaust gas sensor. The exhaust gas that passes by the second exhaust gas sensor is a relatively homogenous mix of the exhaust streams from all cylinders, and thus each cylinder's air-fuel ratio may be equally detected. In order to determine the air-fuel ratio of each cylinder while only measuring a mix of exhaust gas, rather than individual slugs that correspond to each individual cylinder, a plurality of individual cylinder weighting factors are applied to the output from the second exhaust gas sensor. The plurality of individual cylinder weighting factors may reflect each cylinder's contribution to the air-fuel ratio detected by the first exhaust gas sensor, over a plurality of engine operating conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for detecting cylinder air-fuel imbalance using a post-catalyst exhaust gas sensor. Unbalanced cylinder air-fuel ratios may contribute to increased exhaust emissions, and thus engine systems may monitor for unbalanced cylinder air-fuel ratio and adjust engine operation and/or notify an operator if imbalanced cylinder air-fuel ratio is detected. Typically, cylinder imbalance is monitored using an exhaust gas sensor positioned upstream of a catalyst, where individual "slugs" of abnormally rich or lean exhaust gas may be detected moving past the exhaust gas sensor. However, the exhaust gas sensor may not detect exhaust composition from each cylinder equally. For example, exhaust manifold geometry, sensor location, and exhaust gas composition may all effect the sensor's ability to equally monitor each cylinder. As such, it may be difficult to distinguish the difference between a valid imbalance of a weakly sensed cylinder and normal operation of strongly sensed cylinder. Another downside to this monitor is that it requires the exhaust gas sensor to be sampled and processed at a relatively fast rate. This creates significant chronometric loading on the vehicle's controller at high engine speeds, resulting in the monitor being disabled in certain operating regions.

According to embodiments disclosed herein, the post-catalyst exhaust gas sensor (e.g., downstream sensor) may be sampled in order to monitor cylinder air-fuel imbalance. The disclosed cylinder monitor detects how the post-catalyst gas composition changes while in different operating regimes (e.g., different speed-load conditions). The post-catalyst exhaust gas is a blended mix of exhaust gas from all the cylinders on a bank. However, the composition of the mix is biased based on the sensing weight of an individual cylinder by the pre-catalyst sensor (e.g., upstream exhaust gas sensor). As a result, the post-catalyst gas composition is highly sensitive to how the upstream sensor senses each cylinder at a given operating condition.

Through a mapping process the sensing ability can be quantified at various speed/load conditions. This dynamic sensing response of the upstream sensor can be used as a source of natural or passive disturbance. During a typical drive cycle the engine operates at many different speed/load conditions. The cylinder sensing contribution and the resultant post-catalyst air-fuel ratio can be captured forming a dataset with values across the operating spectrum. The dataset can be regressed resulting in the approximate contribution factor for each of the cylinders on a given bank.

Figure 1:
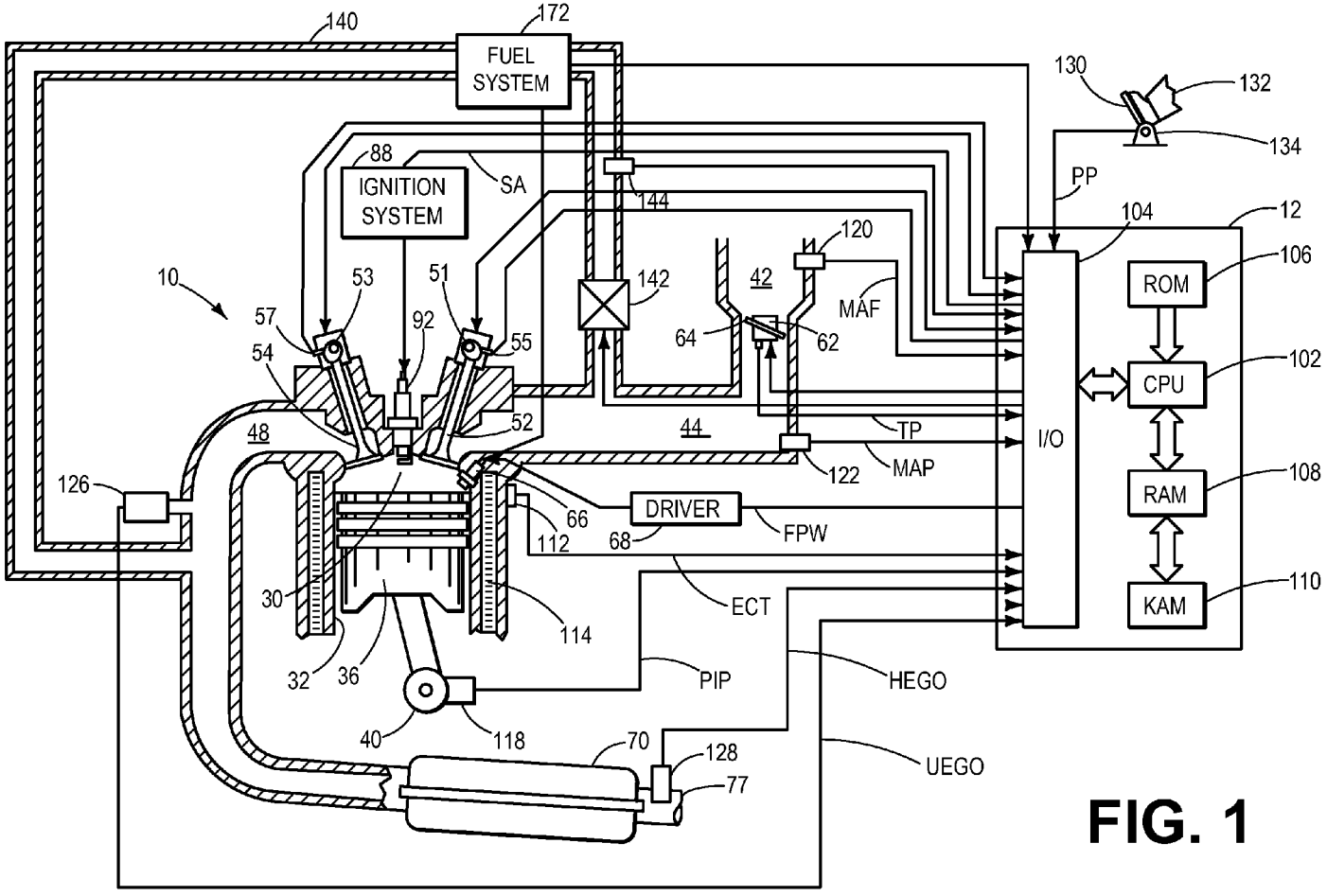
FIG. 1 is a schematic of an engine system illustrating a single cylinder of a multi-cylinder engine.
Figure 2:
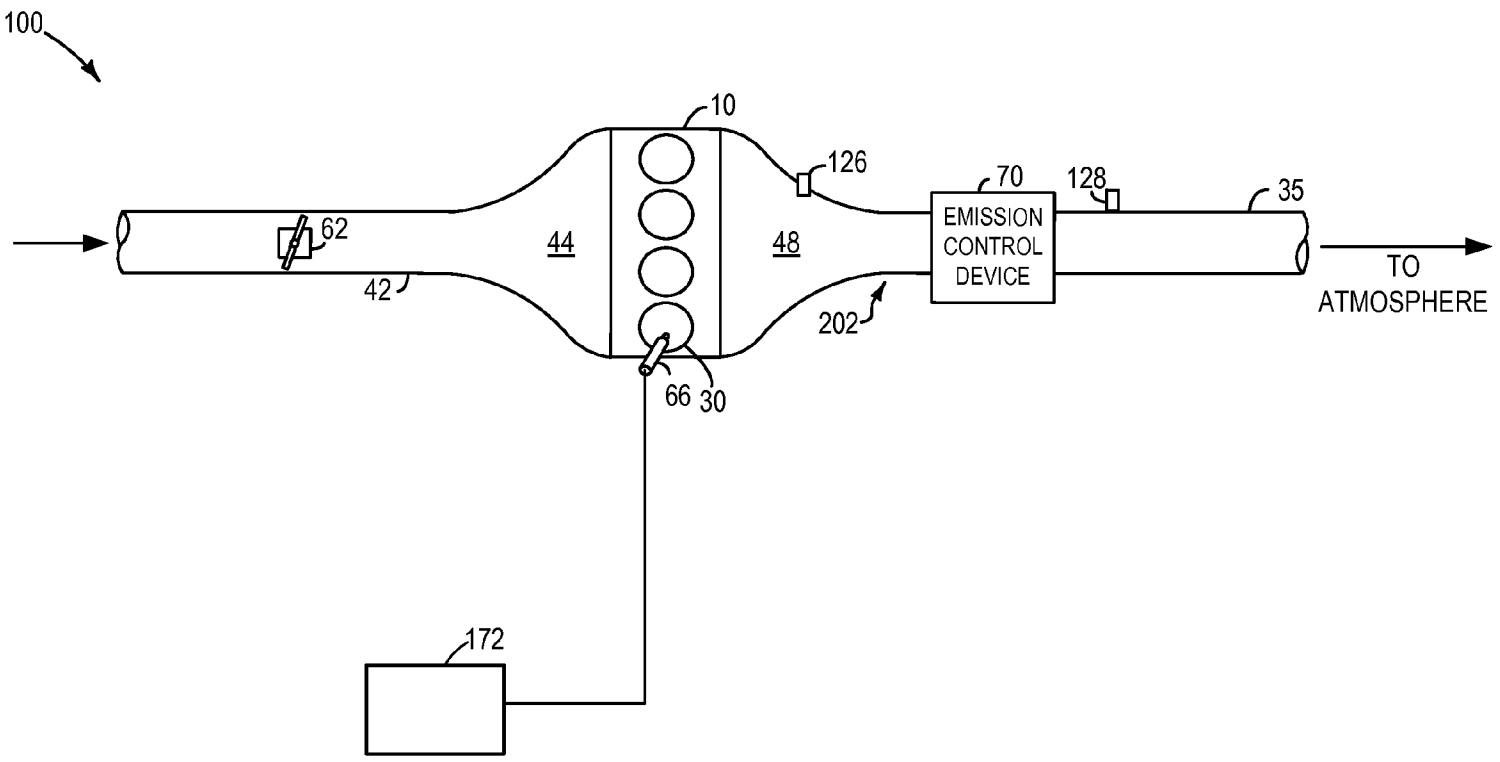
FIG. 2 is a schematic of the engine system of FIG. 1 including the multi-cylinder engine.

This type of processing could be done at a relatively slow rate because the catalyst mixes and filters the gas used for the cylinder imbalance measurement. Thus, there is no benefit to fast sampling. Data for each of these speed/load conditions may be averaged over a specific period of time and the averaged value may be used in the regression to reduce chronometric loading. FIGS. 1-2 illustrate an engine system including a first, upstream sensor and a second, downstream sensor for monitoring cylinder imbalance. The engine system of FIGS. 1-2 also includes a controller storing instructions for carrying out the methods and routines described herein, such as the methods illustrated in FIGS. 3-4.

FIGS. 1-2 illustrate schematic diagrams showing an engine system 100 including a multi-cylinder engine 10 which may be included in a propulsion system of an automobile. FIG. 1 shows one cylinder of multi-cylinder engine 10, while FIG. 2 shows all the cylinders of engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves. In this example, intake valve 52 and exhaust valve 54 may be controlled by cam actuation via one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In some embodiments, each cylinder of engine 10 may be configured with one or more fuel injectors for providing fuel thereto. As a non-limiting example, cylinder 30 is shown including one fuel injector 66, which is supplied fuel from fuel system 172. Fuel injector 66 is shown coupled directly to cylinder 30 for injecting fuel directly therein in proportion to the pulse width of signal FPW received from controller 12 via electronic driver 68. In this manner, fuel injector 66 provides what is known as direct injection (hereafter also referred to as "DI") of fuel into combustion cylinder 30.

It will be appreciated that in an alternate embodiment, injector 66 may be a port injector providing fuel into the intake port upstream of cylinder 30. It will also be appreciated that cylinder 30 may receive fuel from a plurality of injectors, such as a plurality of port injectors, a plurality of direct injectors, or a combination thereof.

Continuing with FIG. 1, intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

A first, upstream exhaust gas sensor 126 is shown coupled to exhaust passage 48 upstream of emission control device 70. Upstream sensor 126 may be any suitable sensor for providing an indication of exhaust gas air-fuel ratio such as a linear wideband oxygen sensor or UEGO (universal or wide-range exhaust gas oxygen), a two-state narrowband oxygen sensor or EGO, a HEGO (heated EGO), a NOx, HC, or CO sensor. In one embodiment, upstream exhaust gas sensor 126 is a UEGO configured to provide output, such as a voltage signal, that is proportional to the amount of oxygen present in the exhaust. Controller 12 uses the output to determine the exhaust gas air-fuel ratio.

Emission control device 70 is shown arranged along exhaust passage 48 downstream of exhaust gas sensor 126. Device 70 may be a three-way catalyst (TWC), configured to reduce NOx and oxidize CO and unburnt hydrocarbons. In some embodiments, device 70 may be a NOx trap, various other emission control devices, or combinations thereof.

A second, downstream exhaust gas sensor 128 is shown coupled to exhaust passage 48 downstream of emissions control device 70. Downstream sensor 128 may be any suitable sensor for providing an indication of exhaust gas air-fuel ratio such as a UEGO, EGO, HEGO, etc. In one embodiment, downstream sensor 128 is a HEGO configured to indicate the relative enrichment or enleanment of the exhaust gas after passing through the catalyst. As such, the HEGO may provide output in the form of a switch point, or the voltage signal at the point at which the exhaust gas switches from lean to rich. As used herein, downstream sensor refers to a sensor located in the exhaust system at a location downstream of an upstream sensor of the exhaust system in an exhaust flow direction. Further, the upstream sensor may be upstream of an emissions control device, such as a catalyst, while the downstream sensor may be downstream of the emissions control device, in an exhaust flow direction. As such, exhaust released from a plurality of cylinders flows past the upstream sensor before flowing past the downstream sensor.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor 144 may be arranged within the EGR passage and may provide an indication of one or more of pressure, temperature, and concentration of the exhaust gas. Under some conditions, the EGR system may be used to regulate the temperature of the air and fuel mixture within the combustion chamber.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure (MAP) signal from sensor 122. Engine speed, RPM, may be generated by controller 12 from signal PIP.

Storage medium read-only memory 106 can be programmed with computer readable data representing non-transitory instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

As described previously, the first, upstream exhaust gas sensor (sensor 126 in FIGS. 1-2) may not sense exhaust from each cylinder equally. As shown in FIG. 2, upstream sensor 126 may be positioned upstream of a confluence area 202 of the exhaust system where the exhaust streams from all the cylinders of a cylinder bank converge. Due to the positioning of upstream sensor 126, the sensor may not sense each cylinder equally at every engine speed and load point. For example, upstream sensor 126 may be positioned closer to a first cylinder of engine 10 than to the remaining cylinders; it may be positioned most distal to a fourth (e.g., cylinder 30 of FIG. 2) cylinder of the engine. This may result in the first cylinder's exhaust being most strongly sampled, at least during some conditions.

In contrast, the exhaust gas sensor located downstream of the confluence area (e.g., downstream sensor 128) samples a mixed and filtered exhaust stream where the exhaust from all the cylinders of the cylinder bank have been mixed into a homogenous stream. Thus, the downstream exhaust gas sensor may sense each cylinder's contribution to the downstream exhaust gas ratio equally.

As will be explained in more detail below with respect to FIG. 3, cylinder air-fuel imbalance may be detected by the downstream exhaust gas sensor, even though the downstream sensor only measures the mixed exhaust gas and thus does not sample slugs of exhaust that correlate to individual cylinder exhaust streams. This is accomplished by using the variation introduced by the uneven upstream exhaust gas sampling as a passive disturbance to the downstream exhaust gas stream that may be used to determine if one or more cylinders are operating with an imbalanced air-fuel ratio.

Figure 3:
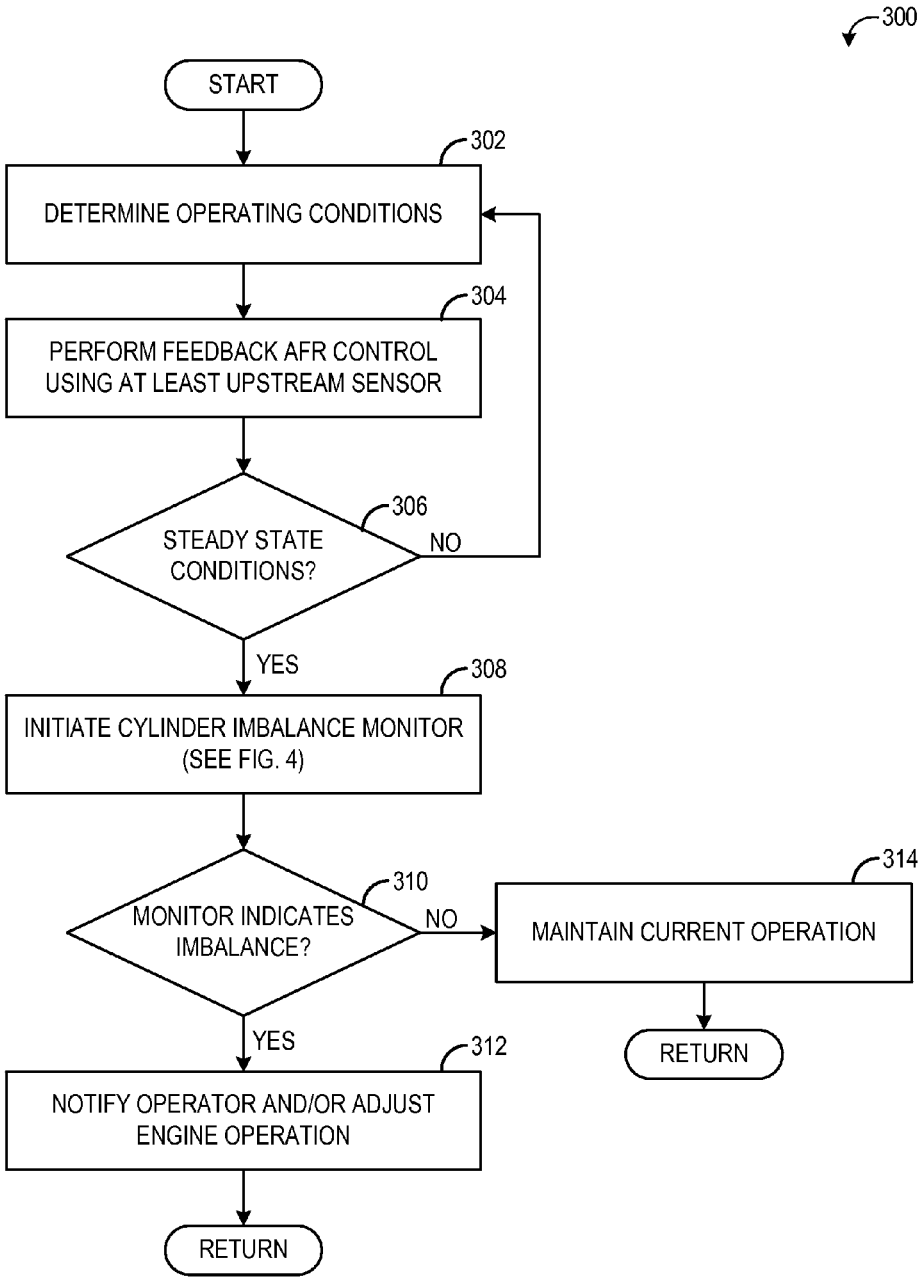
FIG. 3 is a high-level flow chart illustrating a method for determining cylinder air-fuel imbalance.

Turning now to FIG. 3, a method 300 for determining cylinder air-fuel imbalance is illustrated. Method 300 may be performed by a controller, such as controller 12 of FIG. 1, according to non-transitory instructions stored thereon, in order to perform air-fuel ratio control of an engine, such as engine 10 of FIGS. 1-2, based on feedback from a first, upstream exhaust gas sensor (such as upstream sensor 126 of FIGS. 1-2) and a second, downstream exhaust gas sensor (such as downstream sensor 128 of FIGS. 1-2). Method 300 also includes a cylinder imbalance monitor that determines individual cylinder air-fuel ratio based on output from the downstream exhaust gas sensor.

At 302, method 300 includes determining engine operating conditions. The determined conditions may include, but are not limited to, engine speed, engine load, upstream and/or downstream exhaust gas sensor output, and other operating conditions. At 304, method 304 includes performing feedback air-fuel ratio (AFR) control based on output from at least the upstream exhaust gas sensor. The feedback AFR control may include adjusting fuel injection amounts to maintain a desired AFR. For example, an error between the output from the upstream exhaust gas sensor and the desired AFR may be determined, and one or more fuel injectors of the engine may be adjusted to deliver commanded fuel amounts in order to meet the desired AFR. In some examples, output from the downstream exhaust gas sensor may also be used in the feedback AFR control. The desired AFR may be based on engine speed and load, for example.

At 306, method 300 determines if the engine is operating under steady-state operating conditions. The steady-state operating conditions may include engine speed and/or load remaining relatively constant, e.g., changing by less than a threshold amount over a given duration. If no, method 300 loops back to 302 to continue to monitor operating conditions and perform feedback AFR control. If the engine is operating under steady-state conditions, method 300 proceeds to 308 to initiate a cylinder imbalance monitor, which will be explained in more detail below with respect to FIG. 4. Briefly, the cylinder imbalance monitor samples the signal output from the downstream exhaust gas sensor and uses the sampled signal, along with desired AFR for the upstream sensor and a plurality of individual cylinder weighting factors, to calculate individual cylinder air-fuel ratio. If one or more cylinders is undergoing an AFR imbalance (e.g., if one or more cylinders has an AFR that deviates from the AFR of the other cylinders), cylinder imbalance may be indicated. The cylinder imbalance monitor may be initiated under steady-state operating conditions, and not under transient conditions, in order to produce more reliable data (e.g., cylinder air-fuel ratio may change too much during a transient condition, making it difficult to detect imbalance of a cylinder).

At 310, it is determined if the cylinder imbalance monitor indicates that the engine is operating with a cylinder imbalance. If cylinder imbalance is indicated, method 300 proceeds to 312 to notify an operator of the imbalance and/or adjust engine operation. To notify an operator, a malfunction indicator lamp may be turned on, a diagnostic code may be stored in the memory of the controller, or other action may be performed. Further, the engine adjustment may include adjusting fuel injection amounts to the imbalanced cylinder, lowering engine torque, adjusting spark timing, adjusting injection timing, or other engine adjustments to maintain emissions within a designated range. Further, the cylinder imbalance monitor is capable of detecting which cylinder is imbalanced, and if the imbalanced cylinder has a lean imbalance (where the cylinder is operating lean of a desired air-fuel ratio) or if the cylinder has a rich imbalance (where the cylinder is operating rich of a desired air-fuel ratio). If the cylinder has a lean imbalance, fuel injection amount to the cylinder may be increased, while if the cylinder has a rich imbalance, fuel injection amount to the cylinder may be decreased.

If the imbalance monitor does not indicate imbalance, method 300 proceeds to 314 to maintain current operation, including performing the feedback air-fuel ratio control. Method 300 then returns.

Thus, method 300 described above executes a cylinder imbalance monitor during steady-state operating conditions in order to determine cylinder imbalance based on output from the downstream exhaust gas sensor, where exhaust downstream of a catalyst is sampled to measure air-fuel ratio. Because the exhaust downstream of the catalyst is a relatively homogenous mix of the exhaust streams of all the cylinders of an engine or cylinder bank, the downstream air-fuel ratio does not reflect each cylinder's individual air-fuel ratio, regardless of how often the downstream exhaust gas sensor is sampled. However, the upstream exhaust gas sensor does measure individual slugs of exhaust from each cylinder, and furthermore does not measure each cylinder's exhaust equally across all engine speed and load conditions. Because the upstream exhaust gas sensor output is relied on for adjusting the air-fuel ratio of each cylinder, as described above with respect to the feedback air-fuel ratio control, the overall composition of exhaust gas downstream of the catalyst reflects the unequal measuring of the upstream air-fuel ratio. The unequal measuring of the upstream air-fuel ratio may be learned and used to determine a plurality of individual cylinder weighting factors that reflect the upstream sensor's sampling bias over a plurality of different engine speed and load operating conditions. These individual cylinder weighting factors may be used along with measured downstream air-fuel ratio and desired upstream air-fuel ratio for one or more operating conditions to perform a regression analysis to determine each cylinder's individual air-fuel ratio.

Figure 4:
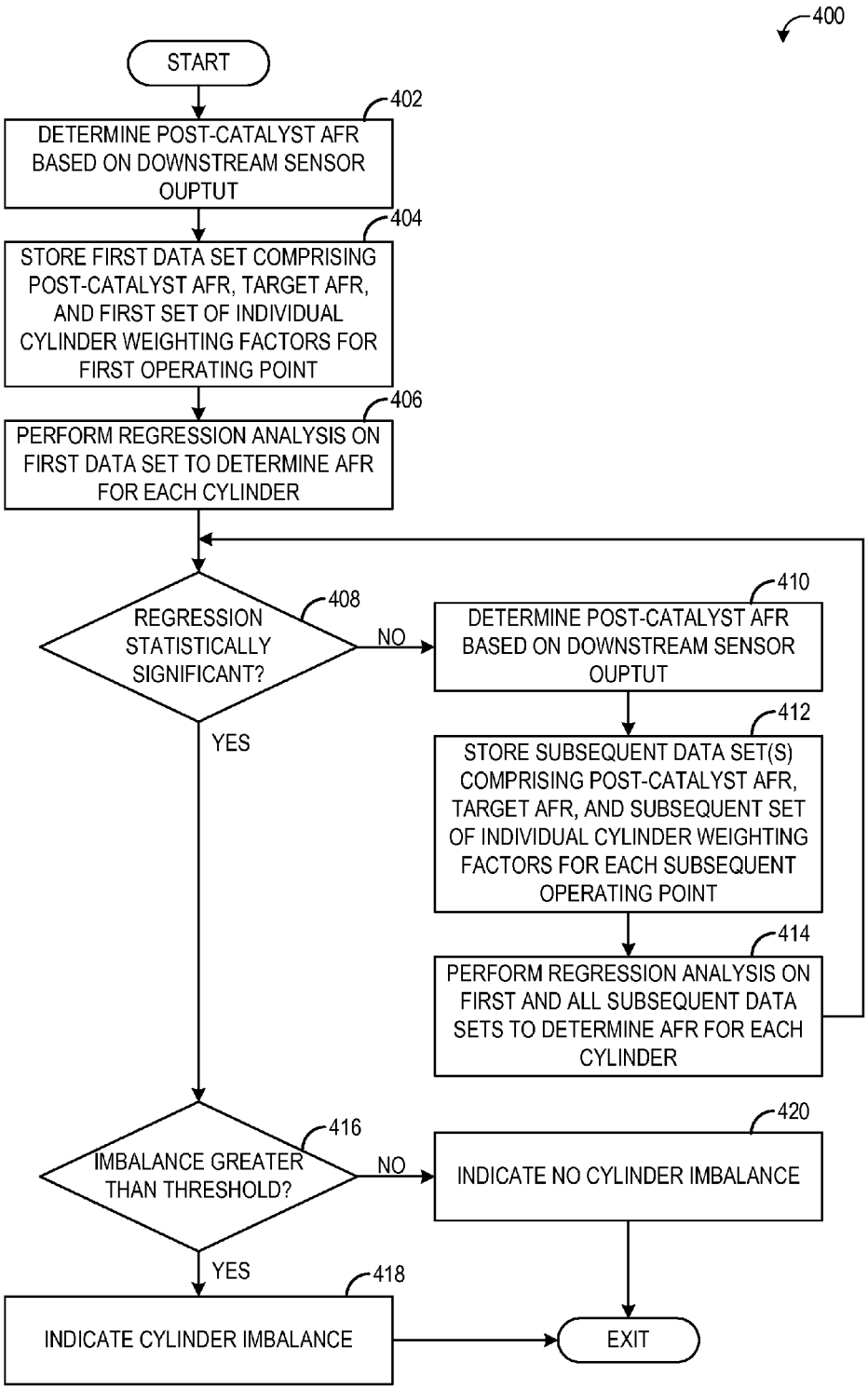
FIG. 4 is a flow chart illustrating a method for detecting individual cylinder air-fuel ratio using a downstream sensor.

Turning to FIG. 4, a method 400 for determining cylinder air-fuel ratio based on output from a second, downstream (e.g., post-catalyst) exhaust gas sensor is presented. Method 400 may be carried out by controller 12 according to non-transitory instructions stored thereon, and executed as part of method 300 described above (e.g., method 400 may be executed once the cylinder imbalance monitor is initiated in method 300).

At 402, method 400 includes determining post-catalyst air-fuel ratio based on output from the second, downstream exhaust gas sensor. At 404, a first data set is stored (e.g., in the memory of the controller). The first data set comprises, for a first engine operating condition, the post-catalyst air-fuel ratio determined at 402, a corresponding desired air-fuel ratio for the first, upstream exhaust gas sensor (e.g., the air-fuel ratio used by the controller along with the upstream sensor output to perform the feedback AFR control, at the same time the post-catalyst air-fuel ratio is determined), and a first set of individual cylinder weighting factors. For example, when the downstream exhaust gas sensor signal is sampled to determine the post-catalyst air-fuel ratio, the engine speed and load at the time of sampling is determined along with the corresponding desired air-fuel ratio. These values are stored in the first data set along with the first set of individual cylinder weighting factors.

The first set of individual cylinder weighting factors includes the contribution of each cylinder to the measured pre-catalyst air-fuel ratio (e.g., the air-fuel ratio measured by the upstream exhaust gas sensor) at the engine speed and load determined above. The first set of individual cylinder weighting factors may be selected from among a plurality of individual cylinder weighting factors that each reflect a contribution of a given cylinder to a measured pre-catalyst air-fuel ratio at a given engine and speed load condition. The plurality of individual cylinder weighting factors may be stored in a map on the memory of the controller.

The plurality of individual cylinder weighting factors may be determined in a suitable manner. In one example, the plurality of individual cylinder weighting factors may be determined during a learning mode of the engine. In the learning mode of the engine, the air-fuel ratio of each cylinder may be purposely varied (e.g., purposely adjusted to run rich or lean) one-by-one and each resultant air-fuel ratio measured by the upstream exhaust gas sensor may be stored along with the engine speed and load at the time the air-fuel ratio was measured. This process may be repeated over one or more engine drive cycles in order to collect air-fuel ratios over a plurality of different engine speed and load conditions. This data may then be used to determine the plurality of individual cylinder weighting factors.

For example, in a four-cylinder engine (or in one bank of a V-8 engine), with no sensing bias of upstream exhaust sensor, each cylinder (e.g., cylinders 1-4) would contribute 25% of the overall exhaust gas sampled. However, due to the placement of the upstream sensor, the actual contribution of each cylinder may not be 25%, and may change depending on engine speed and load. In one example, at low engine speed and low load, cylinders 1 and 2 may each contribute 31.25%, cylinder 3 may contribute 15%, and cylinder 4 may contribute 22.5% of the exhaust gas sampled by the upstream exhaust gas sensor. In contrast, at high engine speed and mid load, cylinder 1 may contribute 15%, cylinder 2 may contribute 22.5%, cylinder 3 may contribute 28.75%, and cylinder 4 may contribute 33.75% of the exhaust gas sampled by the upstream exhaust gas sensor. The plurality of individual cylinder weighting factors reflects this unequal sensing, for each cylinder over a variety of engine operating conditions.

Thus, returning to 404 of method 400, if the post-catalyst air-fuel ratio is determined at a first engine speed and load (such as the low speed and low load conditions described above), the first set of individual cylinder weighting factors would include an individual cylinder weighting factor for each cylinder at the low speed and low load operating condition. In the example described above, the first set of individual cylinder weighting factors may include 0.3125, 0.3125, 0.15, and 0.225 for cylinders 1-4, respectively. It is to be understood that the values provided for the individual cylinder weighting factors are exemplary in nature, as other values or representations are possible. For example, the individual cylinder weighting factors may be represented as a percentage value or other suitable representation.

At 406, a regression analysis is performed on the first data set in order to determine an air-fuel ratio for each cylinder. As explained above, the downstream exhaust gas sensor output does not directly measure the air-fuel ratio for each individual cylinder (due to the fact that the downstream sensor is a narrowband sensor and because it samples an even mix of all exhaust from the cylinders). However, the air-fuel ratio for each cylinder can be derived from other measurements, according to the equation:

$$[\varphi_{Outer}]=[C_{cyl}][\beta_{cyl}][\varphi_{Inner}]+[\varphi_{bias}]$$

where $[\varphi_{Outer}]$ is measured air-fuel ratio from the second, downstream exhaust gas sensor, $[C_{cyl}]$ is the unknown air-fuel contribution for a given cylinder, $[\beta_{cyl}]$ is the individual cylinder weighting factor for that cylinder, $[\varphi_{Inner}]$ is the desired air-fuel ratio for the first, upstream exhaust gas sensor, and $[\varphi_{bias}]$ is a bias compensation for the downstream exhaust gas sensor.

The values for $[C_{cyl}]$ for each cylinder may be determined via the regression analysis. The regression analysis determines a value of one or more unknown independent variables (e.g., $[C_{cyl}]$ for each cylinder) based on a dependent variable (herein, the downstream air-fuel ratio) and additional known independent variables (e.g., the desired air-fuel ratio). The regression analysis may be a suitable regression analysis, such as parametric or non-parametric, linear or non-linear, etc.

At 408, it is determined if the regression analysis is statistically significant. This may be determined in a suitable manner. In one example, the regression analysis may only provide reliable estimates for $[C_{cyl}]$ for each cylinder when the dependent variable is measured at a number of different values for the known independent variables. For example, in a four-cylinder engine (or cylinder block having four cylinders), four values for $[C_{cyl}]$ are needed (e.g., one for each cylinder). Thus, the downstream air-fuel ratio may be measured at least at four different desired air-fuel ratios and/or at least at four different engine speed and load conditions. Further, the downstream air-fuel ratio may be measured more than one time at each different independent variable.

If the regression analysis is not determined to be statistically significant, method 400 proceeds to 410 to again determine the post-catalyst air-fuel ratio based on the downstream sensor output, store a subsequent data set at 412 comprising the post-catalyst air-fuel ratio measured at 410, a corresponding desired air-fuel ratio for the upstream sensor, and a subsequent set of individual cylinder weighting factors for a subsequent operating point (e.g., the same engine speed and load the first data set, or a different speed and load), and perform the regression analysis again using the first data set and the subsequent data set. The method then loops back to 408 to determine if the regression analysis is statistically significant. If the analysis is not significant, the method repeats 410-414, collecting one or more subsequent data sets and performing the regression analysis, until the regression analysis has enough samples to be statistically significant.

When the regression is determined to be statistically significant at 408, method 400 proceeds to 416 to determine if a cylinder imbalance greater than a threshold is present, based on the results from the regression analysis. As explained previously, the regression analysis determines an air-fuel ratio for each cylinder. Cylinder imbalance may be determined if one or more cylinders has an air-fuel ratio that is different than a threshold air-fuel ratio, for example if a cylinder has an air-fuel ratio that is different than an average air-fuel ratio for all the cylinders, or if a cylinder has an air-fuel ratio that is different than a desired air-fuel ratio. If the imbalance is greater than the threshold, method 400 proceeds to 418 to indicate cylinder imbalance. If the imbalance is not greater than the threshold, the method proceeds to 420 to indicate no cylinder imbalance. Method 400 then exits.

The methods 300 and 400 described above monitor for cylinder imbalance using output from a post-catalyst, downstream exhaust gas sensor that samples exhaust downstream of where the exhaust streams from a plurality of cylinders converge. The cylinder imbalance monitor relies on the fact that the pre-catalyst, upstream exhaust gas sensor, which samples exhaust upstream of where the exhaust streams from the plurality of cylinders converge, does not measure the contribution from each cylinder equally (as the contribution measured by the sensor varies with exhaust flow dynamics), thus effecting the gas composition at the downstream sensor. The imbalance monitor also relies on the engine running at different operating conditions that produce different flow dynamics.

The downstream sensor samples the post-catalyst exhaust gas for the entire plurality of cylinders. The downstream sensor provides no direct measurement of cylinder air-fuel ratio (e.g., because it is a narrowband sensor), but the cylinder air-fuel ratio values may be derived from other measurements and controls. In this case, the upstream sensor is not used directly. The physical position of the upstream sensor relates to the contribution of the upstream sensor reading from each cylinder at a given operating point. Weighting factors for each cylinder may be mapped and stored in a table. Regression of selected mapped values, along with downstream air-fuel ratio, yields values for the air-fuel contribution for each cylinder, which may be processed to determine the balance of cylinders.

The technical effect of monitoring for cylinder air-fuel imbalance using output from a downstream exhaust gas sensor (e.g., downstream of a catalyst) is equal sensing of each cylinder's air-fuel ratio over a plurality of operating conditions, while reducing processing load on the controller.

In an embodiment, method for an engine comprises adjusting engine operation based on an indication of cylinder air-fuel imbalance, the imbalance detected based on output from a second sensor and a plurality of individual cylinder weighting factors, the second sensor located in an exhaust system downstream of a first sensor located in the exhaust system. The second sensor is located in the exhaust system downstream of a confluence area where exhaust streams from a plurality of cylinders converge, and the first sensor is located upstream of the confluence area.

Each of the plurality of individual cylinder weighting factors describes a contribution of a given cylinder to an overall air-fuel ratio sensed by the first sensor for a given engine speed and load condition. The plurality of individual cylinder weighting factors comprises a weighting factor for each cylinder of the plurality of cylinders for at least one engine speed and load condition. The indication of cylinder air-fuel imbalance may be further based on a desired air-fuel ratio at the first sensor.

To determine the cylinder air-fuel imbalance, the method includes, for a first engine speed and load condition: storing a first data set comprising a first downstream air-fuel ratio measured by the second sensor, a corresponding first desired air-fuel ratio for the first sensor, and a first subset of the plurality of individual cylinder weighting factors, the first subset including a weighting factor for each of the plurality of cylinders at the first engine speed and load condition; and performing a first regression analysis on the first data set to determine a first air-fuel ratio for each cylinder of the plurality of cylinders. The method further comprises indicating the cylinder air-fuel imbalance if at least one of the first air-fuel ratios differs from an average air-fuel ratio by more than a threshold.

To determine the cylinder air-fuel imbalance, the method may further comprise, for a second engine speed and load condition: storing a second data set comprising a second downstream air-fuel ratio measured by the second sensor, a corresponding second desired air-fuel ratio for the upstream exhaust gas sensor, and a second subset of the plurality of individual cylinder weighting factors, the second subset including a weighting factor for each of the plurality of cylinders at the second engine speed and load condition; and performing a second regression analysis on the first data set and second data set to determine a second air-fuel ratio for each cylinder of the plurality of cylinders.

The method may further comprise iteratively repeating the storing and performing of the regression analysis for one or more subsequent engine and speed load conditions until the regression analysis is indicated to be statistically significant, and indicating the cylinder air-fuel imbalance if an air-fuel ratio for at least one cylinder of the plurality of cylinders determined by the statistically-significant regression analysis differs from an average air-fuel ratio by more than a threshold.

In one example, the adjusting engine operation comprises adjusting a fuel injection amount supplied to the at least one cylinder. In other examples, the adjusting engine operation comprises one or more of adjusting an engine torque limit, lowering boost pressure, adjusting fuel injection timing, and reducing spark retard.

The second sensor is located downstream of a catalyst positioned in an exhaust passage that is in fluidic communication with the engine, and the first sensor is located upstream of the catalyst.

The method further comprises learning the plurality of individual cylinder weighting factors during a learning mode of the engine. The learning mode of the engine comprises for each of a plurality of engine speed and load conditions, purposely varying an air-fuel ratio for each cylinder of the plurality of cylinders and measuring each resultant exhaust air-fuel ratio with the first sensor; and determining the plurality of the individual cylinder weighting factors based on the resultant exhaust air-fuel ratios for each cylinder at each of the plurality of engine speed and load conditions.

Another method for an engine comprises indicating a cylinder air-fuel imbalance based on a regression analysis performed on a plurality of measured post-catalyst air-fuel ratios, a plurality of corresponding desired pre-catalyst air-fuel ratios, and a plurality of individual cylinder weighting factors.

The plurality of individual cylinder weighting factors each describe a contribution of a given cylinder to a pre-catalyst air-fuel ratio sensed by an upstream exhaust gas sensor for a given engine speed and load condition. The method further comprises adjusting engine operation in response to the indicated cylinder imbalance. The adjusting engine operation includes increasing an amount of fuel delivered to a cylinder associated with the cylinder air-fuel imbalance when the cylinder air-fuel imbalance indicates a lean imbalance. The adjusting engine operation includes decreasing an amount of fuel delivered to a cylinder associated with the cylinder air-fuel imbalance when the cylinder air-fuel imbalance indicates a rich imbalance.

An embodiment of a system comprises an engine having a plurality of cylinders; an exhaust manifold fluidically coupled to the plurality of cylinders and to an exhaust passage; a catalyst positioned in the exhaust passage; an upstream exhaust gas sensor positioned upstream of the catalyst; a downstream exhaust gas sensor positioned downstream of the catalyst; and a controller with computer-readable instructions for: measuring post-catalyst air-fuel ratio with the downstream exhaust gas sensor at a plurality of different operating conditions; performing a regression analysis to determine an air-fuel ratio of each cylinder of the plurality of cylinders; and indicating a cylinder imbalance based on the air-fuel ratio of each cylinder, where the regression analysis is performed on each measured post-catalyst air-fuel ratio, a plurality of corresponding desired pre-catalyst air-fuel ratios, and a plurality of individual cylinder weighting factors that each reflect a contribution of a particular cylinder to a pre-catalyst air-fuel ratio sensed by the upstream exhaust gas sensor for a given engine speed and load condition.

The upstream exhaust gas sensor may be positioned in the exhaust manifold in one example. In another example, the upstream exhaust gas sensor may be positioned in the exhaust passage downstream of the exhaust manifold and upstream of the catalyst. The upstream exhaust gas sensor is a wideband sensor and the downstream exhaust gas sensor is a narrowband sensor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

adjusting engine operation based on an indication of cylinder air-fuel imbalance detected based on at least two regression analyses, the at least two regression analyses including a first regression analysis performed on a first dataset and a second regression analysis performed on a larger, second dataset, and each of the first dataset and the second dataset including output from a second sensor, located in an exhaust system downstream of a first sensor located in the exhaust system, and a plurality of individual cylinder weighting factors each describing a contribution of a respective individual cylinder to an overall air-fuel ratio sensed by the first sensor for a given engine speed and load condition.

2. The method of claim 1, wherein the second sensor is located in the exhaust system downstream of a confluence area where exhaust streams from a plurality of cylinders converge.

3. The method of claim 2, wherein the first sensor is located upstream of the confluence area, and wherein the plurality of individual cylinder weighting factors comprises a weighting factor for each cylinder of the plurality of cylinders for at least one engine speed and load condition.

4. The method of claim 3, wherein, to determine the cylinder air-fuel imbalance, the method comprises, for a first engine speed and load condition:

storing the first data set comprising a first downstream air-fuel ratio measured by the second sensor, a corresponding first desired air-fuel ratio for the first sensor, and a first subset of the plurality of individual cylinder weighting factors, the first subset including a weighting factor for each of the plurality of cylinders at the first engine speed and load condition; and performing the first regression analysis on the first data set to determine a first cylinder air-fuel ratio for each cylinder of the plurality of cylinders.

5. The method of claim 4, wherein, to determine the cylinder air-fuel imbalance, the method further comprises, for a second engine speed and load condition:

storing the second data set comprising a second downstream air-fuel ratio measured by the second sensor, a corresponding second desired air-fuel ratio for the first sensor, and a second subset of the plurality of individual cylinder weighting factors, the second subset including a weighting factor for each of the plurality of cylinders at the second engine speed and load condition; and performing the second regression analysis on the first data set and the second data set to determine a second cylinder air-fuel ratio for each cylinder of the plurality of cylinders.

6. The method of claim 5, further comprising iteratively repeating the storing and performing of a subsequent regression analysis for one or more subsequent engine speed and load conditions until the subsequent regression analysis is indicated to be statistically significant, and indicating that the cylinder air-fuel imbalance is a cylinder air-fuel imbalance for a first cylinder of the plurality of cylinders if a statistically-significant air-fuel ratio for the first cylinder of the plurality of cylinders determined by the statistically-significant regression analysis differs from an average air-fuel ratio by more than a threshold.

7. The method of claim 6, wherein adjusting engine operation comprises adjusting a fuel injection amount supplied to the first cylinder.

8. The method of claim 2, wherein the second sensor is located downstream of a catalyst positioned in an exhaust passage that is in fluidic communication with the engine, and wherein the first sensor is located upstream of the catalyst.

9. The method of claim 3, further comprising learning the plurality of individual cylinder weighting factors during a learning mode of the engine, the learning mode of the engine comprising:

for each of a plurality of engine speed and load conditions, purposely varying an air-fuel ratio for each cylinder of the plurality of cylinders and measuring each resultant exhaust air-fuel ratio with the first sensor, and determining the plurality of individual cylinder weighting factors based on the resultant exhaust air-fuel ratios for each cylinder at each of the plurality of engine speed and load conditions.

10. The method of claim 1, wherein adjusting engine operation comprises one or more of adjusting an engine torque limit, lowering boost pressure, adjusting fuel injection timing, and reducing spark retard.

11. The method of claim 1, wherein the indication of cylinder air-fuel imbalance is further based on a desired air-fuel ratio at the first sensor.

12. A method for an engine, comprising:

adjusting engine operation based on an indication of cylinder air-fuel imbalance detected based on at least two regression analyses including a first regression analysis and a second regression analysis each performed on respective first and second datasets including a plurality of measured post-catalyst air-fuel ratios, a plurality of corresponding desired pre-catalyst air-fuel ratios, and a plurality of individual cylinder weighting factors each describing a contribution of a respective individual cylinder to an overall air-fuel ratio sensed at a pre-catalyst location for a given engine speed and load condition, wherein the second dataset includes the first dataset, and wherein the second dataset is larger than the first dataset.

13. The method of claim 12, where adjusting engine operation includes increasing an amount of fuel delivered to a cylinder associated with the cylinder air-fuel imbalance when the cylinder air-fuel imbalance indicates a lean imbalance.

14. The method of claim 12, where adjusting engine operation includes decreasing an amount of fuel delivered to a cylinder associated with the cylinder air-fuel imbalance when the cylinder air-fuel imbalance indicates a rich imbalance.

15. The method of claim 5, further comprising indicating the cylinder air-fuel imbalance if at least one of the second cylinder air-fuel ratios differs from an average air-fuel ratio by more than a threshold.

* * * * *